US005643529A

United States Patent [19]

Scriven

[11] Patent Number: 5,643,529

[45] Date of Patent: Jul. 1, 1997

[54] THERMAL INSULATION COVER FOR MOLTEN METAL TRANSFER CAR

[76] Inventor: Ricky R. Scriven, 13644 Ridge Rd., Milan, Mich. 48160

[21] Appl. No.: 554,863

[22] Filed: Nov. 21, 1995

Related U.S. Application Data

[63] Continuation-in-part of Ser. No. 114,152, Sep. 1, 1993, abandoned.

[51] Int. Cl.[6] ..... C21B 3/10

[52] U.S. Cl. ..... 266/165; 266/272

[58] Field of Search ..... 266/165, 248, 266/280, 287, 271, 272

[56] References Cited

U.S. PATENT DOCUMENTS

| | | | |
|---|---|---|---|
| 2,216,813 | 10/1940 | Goldschmidt | 266/280 |
| 2,791,116 | 5/1957 | Heufer et al. | 266/280 |
| 4,381,855 | 5/1983 | Ryan | 266/248 |
| 4,424,956 | 1/1984 | Grant et al. | 266/287 |
| 4,524,954 | 6/1985 | Baas et al. | 266/45 |
| 4,577,839 | 3/1986 | Carlson et al. | 266/280 |
| 5,022,635 | 6/1991 | Scriven | 266/165 |
| 5,439,202 | 8/1995 | Scriven | 266/165 |

*Primary Examiner*—Scott Kastler
*Attorney, Agent, or Firm*—Weintraub DuRoss & Brady

[57] ABSTRACT

A pre-formed rigid ceramic thermal insulating heat conservation cover is placed over and fitted into the opening of a hot liquid metal transfer car. The cover reduces thermal loss from the liquid metal by a non-metallic middle sheet encapsulated by an upper metallic sheet and a lower metallic sheet. The middle sheet is formed of fused ceramic and silica sand.

5 Claims, 1 Drawing Sheet

THERMAL INSULATION COVER FOR MOLTEN METAL TRANSFER CAR

CROSS-REFERENCE TO RELATED APPLICATION

This application is a continuation-in-part application of U.S. Pat. application Ser. No. 08/114,152, filed Sep. 1, 1993, for "Thermal Insulation Cover of Molten Metal Transfer Car", now abandoned, the disclosure of which is hereby incorporated by reference.

BACKGROUND OF INVENTION

1. Field of Invention

The invention relates to covers for molten metal transfer cars. More particularly, the present invention concerns thermal insulation covers for transfer cars carrying molten metal.

2. Description of Prior Art

Transfer cars to move molten metals between various processing stations in a steel mill or foundry are well known. One problem related to this transportation system is the heat lost by the molten metal during transport. If the liquid metal cools below a certain point, the metal may, at a minimum, solidify within the car. Additionally, an alloy contained therein could undergo structural change that could adversely affect the capability of the metal to perform, as required.

One method of addressing this problem is to add additional heating furnaces along the processing line. The furnaces could then ensure that thermal loss is not so substantial as to affect the molten metal. However, such additional furnaces add to the processing time and cost.

A less costly alternative is to cover the central opening of the transport car. Since the greatest thermal loss occurs through this opening in the top of the car, a cover over this area will preserve the heat of the metal, because of its structural integrity, and maintain a heated transfer car after metal is removed. Traditionally, such covers have been made of metal, but metal covers act as thermal conductors. Therefore, such covers are poor choices to preserve heat.

A non-metal cover is taught in U.S. Pat. No. 4,381,855, issued May 3, 1983 to Ryan and entitled "TECHNIQUE FOR CONSERVING HOT METAL TEMPERATURE." Ryan teaches a flexible cover made of a thermal insulating material, which is commercially available under the trade name KAOWOOL. The KAOWOOL insulation material is held by a flexible screen, the screen and insulating material conforming to the size of the opening of the tanker car.

While the cover of Ryan lessens the heat loss from the molten metal of the car, it has drawbacks. Specifically, the flexibility of the Ryan cover makes deployment and removal of the cover cumbersome. Further, the constant exposure to the extreme heat of the metal disintegrates the screen, thus requiring frequent replacement of the screen.

What is needed is a non-metallic, non-heat conductive cover that is rigid, for easy deployment, and that is capable of withstanding the heat exposure. Further, a cover is needed that is conformable to the opening while being rigid and durable. It is to these needs that the present invention is directed.

SUMMARY OF THE INVENTION

The present invention concerns a thermal insulation cover for a transport car that is rigid and easily deployable, the cover comprising:

(a) a metallic lower sheet;

(b) a metallic upper sheet;

(c) a non-metallic middle sheet comprising a fused woven blend of ceramic fiber and silica sand; and wherein the lower sheet and the upper sheet are joined together and encapsulate the middle sheet, forming the unitary rigid cover.

The cover may additionally comprise means for holding the cover in the opening of the transport car. The means for holding may, in a preferred embodiment hereof, comprise a border portion formed in each of the lower, upper and middle sheets.

Additionally, both the upper sheet and the lower sheets, in a preferred embodiment hereof, comprise a metal mesh.

The present invention will be better understood by reference to the following detailed description in conjunction with the accompanying drawings, wherein like reference numerals refer to like parts throughout the views, and in which:

DESCRIPTION OF THE PREFERRED EMBODIMENT

Figure 1:
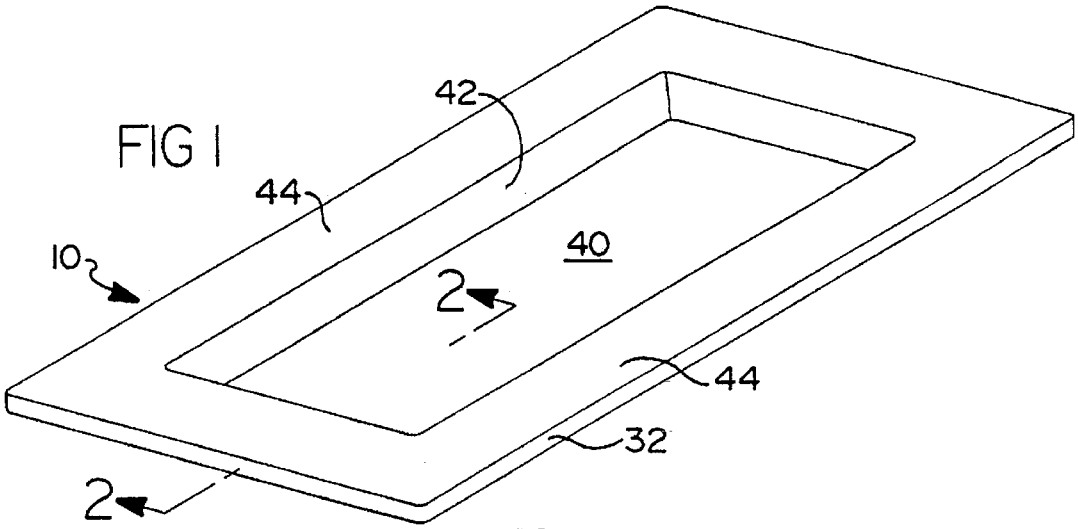
FIG. 1 is a perspective view of the cover of the present invention.
Figure 2:
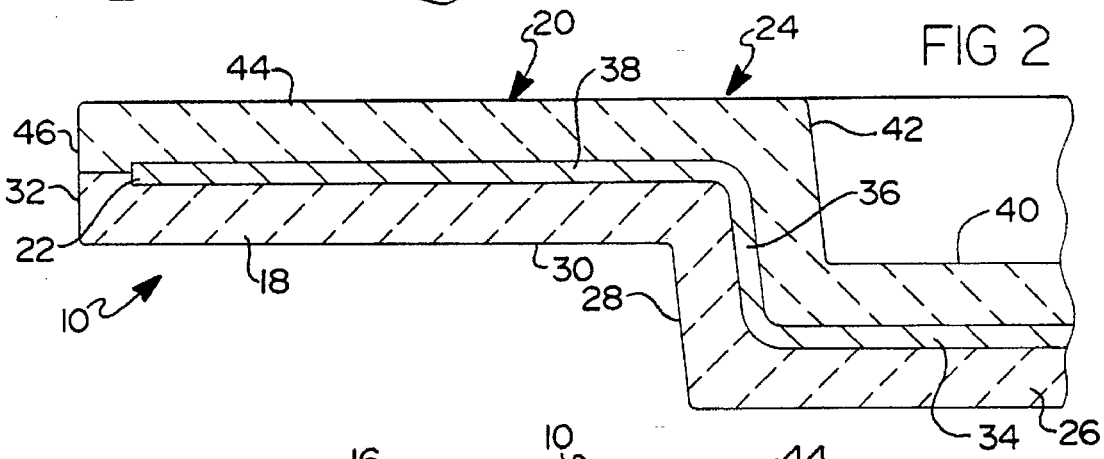
FIG. 2 is a cross-sectional view of a portion of the cover of the present invention taken along line 2—2 of FIG. 1.
Figure 3:
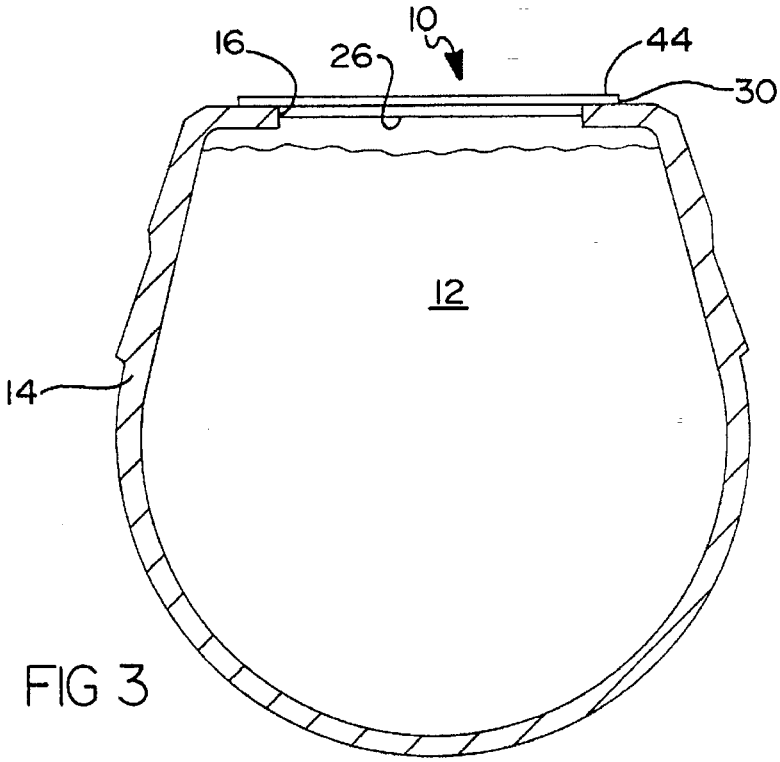
FIG. 3 is a cross-sectional view of a transport car having the cover of the present invention deployed over an opening thereof.

Referring now to FIGS. 1–3, there is depicted therein a cover 10 in accordance with the present invention. The cover or lid 10 prevents thermal heat loss from molten metal 12 contained within a transport car 14. The transport car 14 has an opening 16 into which the cover 10 is inserted and which is removably deployed thereover. The cover 10 precludes any substantial contact between the molten metal 12 and the atmosphere.

As shown, the cover 10 comprises a lower sheet 18, an upper sheet 20 and a middle sheet 22 disposed between the lower sheet 18 and the upper sheet 20. The cover 10 further comprises means 24 for holding the cover 10 over the opening 16 of the transport car 14.

The lower sheet 18 is formed of a metal, preferably similar to the metal from which the transport car 14 is formed. The sheet 18 is, preferably, a metal mesh material. However, the sheet 18 may comprise a solid metal sheet. Mesh offers advantages over a solid sheet in that mesh imparts less weight to the cover 10, since it comprises less metal. Additionally, since a mesh requires less metal than a solid member, there is less heat absorbed by the cover 10. Therefore, the cover 10 can more readily be handled. Also, less heat is transmitted through the cover 10 and the non-metallic middle sheet 22, as described in further detail herein below.

The lower sheet 18 has a central portion or depression 26, which is essentially a flat surface. A flange portion 28 is integrally formed with the central portion 26 about the circumference of the central portion. The flange portion is bent, in such manner that it rises from and is substantially vertical to the central portion 26. The flange portion 28 and the depression 26 conform to the opening 16 of the transfer car 14. As such, the depression 26 seats within the opening and the flange abuts against the perimeter thereof, as shown.

A border portion 30 is integral with the flange portion 28. The border portion 30 extends substantially parallel to the central portion 26. The border position 30 has a lip 32 integrally formed around the outer circumference thereof. The lip 32 contacts the upper sheet 20, as set forth hereinbelow.

The middle sheet 22 comprises a central portion or depression 34, a flanged portion 36 and a border portion 38, substantially similar to that of the lower sheet 18. The middle sheet 22 is laid upon the lower sheet 18, such that the upper surface of the lower sheet 18 and the lower surface of the middle sheet 22 are in substantially complete contact. The middle sheet 22 does not have a lip as the lower sheet 18. The middle sheet 22 is secured and surrounded therearound by the lip 32 of the lower sheet 18, as shown.

The middle sheet 22 is formed of a non-metallic material, preferably a ceramic. As is known, a ceramic material acts as a thermal insulator, yet is relatively light weight. As such, a ceramic is well suited to the present task. In the preferred embodiment, the middle sheet 22 comprises a mixture of:

(a) a commercially available ceramic called CEROWOOL, which is available from the Johns Manville Company; and (b) silica sand.

Using the known technique of plasma torch stranding, the sand and the CEROWOOL are made into strands and then woven and fused into a rigid and inflexible middle sheet 22. By sandwiching the middle sheet 22 between the lower sheet 18 and the upper sheet 20, the ceramic middle sheet 22 acts as a thermal buffer, so that the metal lower sheet 18 cannot transmit heat therethrough and into the atmosphere. This makes for an effective rigid thermal insulting cover 10.

The upper sheet 20 is formed of rigid metal, similar to that of the lower sheet 18. The upper sheet 20 comprises a central depressed portion 40, a flange portion 42 and a border portion 44. The upper sheet 20 further comprises a lip 46, which is substantially normal to the border portion 44. The sheet 20 is substantially similar in formation to the lower sheet 18 and the middle sheet 22. The upper sheet 20 is laid atop the middle sheet 22, such that the lower surface of the upper sheet 20 is in substantially complete contact with the upper surface of the middle sheet 22. The lip 46 touches the lip 32 of the lower member, such that the middle portion 22 is completely encapsulated by the lower sheet 18 and the upper sheet 20. The sheets 18, 20 are joined together by welding or other suitable sealing means.

The cover 10 may further comprise means 24 for holding the cover 10 within the opening 16. In the preferred embodiment, the means 24 comprises the border portions 30, 44 of the sheets 18, 20. The border portion 30 rests upon the transport car 14 proximate the opening 16, as shown.

In an alternate embodiment hereof, the means 24 for holding comprises means for connecting the cover 10 to an apparatus for removing the cover 10. One such apparatus is disclosed in U.S. Pat. No. 5,022,635 which issued to Scriven as well as co-pending U.S. Patent application entitled "APPARATUS FOR REMOVING A COVER FROM A HOT METAL TRANSFER CAR", filed on evendate therewith and which is incorporated herein by reference. Additionally, hooks not shown or other well-known means for attaching may be used to effect grasping of the cover 10.

The cover 10, as noted, is rigid by virtue of the middle sheet 22 being formed of a ceramic, as well as the upper or lower sheet, if made of a solid sheet, each of which is inflexible. This rigidity gives improved handling and ensures blockage of the opening 16. The cover 10 can be formed to any configuration, i.e. round, rectangular, square, etc. What is important is that the cover 10 be rigid and configured to block the opening 16 to prevent heat loss by sealing the thermal energy within the transport car 14. Additionally, heat loss from the transport car 14 occurs when the transfer car 14 is empty. If cover 10 is in place over the transport car opening 16 when it is empty, this also preserves heat within the car 14.

Because of the material used for construction of the cover 10, the heated metal being poured into the transport car 14 may be poured directly onto the cover 10. The cover disintegrates with the material dissolving into the molten metal. The material does not contaminate the metal. The disintegrated cover 10 is replaced with a new cover 10 and placed over the opening 16 when the molten material fills the transport car 14.

What is to be noted with respect hereto and what is distinct from the prior art is that since cover 10 is rigid it is necessarily pre-formed.

Having, thus, described the present invention, what is claimed is:

1. A pre-formed rigid, thermal insulation cover for a transport car comprising:

(a) a metallic lower sheet;

(b) a metallic upper sheet;

(c) a non-metallic middle sheet comprising a fused woven blend of ceramic fibers and silica sand sheet; and wherein the lower sheet and the upper sheet are joined together and encapsulate the middle sheet, forming the unitary rigid cover.

2. The cover of claim 1, further comprising means for holding the cover over an opening of a transport car.

3. The cover of claim 2, wherein the means for holding comprises the border portion formed in the cover.

4. The cover of claim 1, wherein both the upper sheet and the lower sheet are metallic mesh.

5. A preformed, rigid thermal insulation cover for deployment in the opening of a transport car to preserve the heat of a molten metal, the cover comprising:

(a) a metallic mesh lower sheet having:

(1) a central portion;

(2) a flange portion integral with the central portion;

(3) a border portion integral with the flange portion; and (4) a lip integral with the border portion;

(b) a metallic mesh upper sheet having:

(1) a central portion;

(2) a flange portion integral with the central portion;

(3) a border portion integral with the flange portion;

(4) a lip integral with the border portion, and wherein the lip of the upper sheet contacts and rests upon the lip of the lower sheet;

(c) a non-metallic middle sheet fused of ceramic and silica sand, the middle sheet having:

(1) a central portion;

(2) a flange portion integral with the central portion;

(3) a border portion integral with flange portion; and wherein the middle portion is encapsulated between the lower and upper sheets, the middle portion acting as a thermal insulator, the central portion of the cover seating in the opening, the flange portion abutting against the periphery thereof and the border being disposed about the periphery.

* * * * *